US007237885B1

(12) United States Patent
Sasaki et al.

(10) Patent No.: US 7,237,885 B1
(45) Date of Patent: Jul. 3, 2007

(54) INK CARTRIDGES

(75) Inventors: Toyonori Sasaki, Anjo (JP); Makoto Yamada, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 11/536,668

(22) Filed: Sep. 29, 2006

Related U.S. Application Data

(60) Provisional application No. 60/826,254, filed on Sep. 20, 2006.

(30) Foreign Application Priority Data

Mar. 24, 2006 (JP) ..... 2006-082769

(51) Int. Cl.
*B41J 2/175* (2006.01)
*B41J 2/195* (2006.01)

(52) U.S. Cl. ..... 347/86; 347/7

(58) Field of Classification Search ..... 347/7, 347/84–86; 73/290 R, 291–333; 137/395, 137/397, 398, 558; 116/227–229
See application file for complete search history.

(56) References Cited

U.S. PATENT DOCUMENTS 6,390,590 B1 * 5/2002 Hansburg ..... 347/19
6,554,381 B2 * 4/2003 Locher et al. ..... 347/7
7,097,290 B2 * 8/2006 Yoshida ..... 347/85
2005/0068389 A1 3/2005 Katayama et al.

FOREIGN PATENT DOCUMENTS

JP 03-178790 * 1/1993
JP 8281966 A 10/1996
JP 7314716 A 12/1996
JP 200434406 A 2/2004

* cited by examiner

*Primary Examiner*—Stephen Meier
*Assistant Examiner*—Geoffrey S. Mruk
(74) *Attorney, Agent, or Firm*—Baker Botts L.L.P.

(57) ABSTRACT

An ink cartridge includes a movable member which includes a signal blocking portion disposed within an inner space of a translucent portion, and a float portion disposed within an ink chamber. The float portion is configured to move between a first position and a second position based at least on an amount of ink disposed within the ink chamber. Specifically, as the ink within the ink chamber is dispensed from the interior of the ink chamber to the exterior of the ink chamber a surface of the ink within the ink chamber moves in a first predetermined direction. Moreover, when the float portion moves from the first position to the second position each of the float portion and the signal blocking portion moves in a second predetermined direction which is slanted with respect to the first predetermined direction.

8 Claims, 11 Drawing Sheets

INK CARTRIDGES

CROSS-REFERENCE TO RELATED APPLICATIONS

The present application claims priority from Japanese Patent Application No. JP-2006-082769, which was filed on Mar. 24, 2006, and U.S. Provisional Patent Application No. 60/826,254, which was filed on Sep. 20, 2006, the disclosures of which are incorporated herein by reference in their entirety.

BACKGROUND OF THE INVENTION

1. Field of the Invention

The present invention relates generally to ink cartridges. In particular, the present invention is directed towards ink cartridges which may be used in combination with ink jet printers.

2. Description of Related Art

A known printer may be configured to detect when an amount of ink within an ink cartridge is relatively low. For example, a known ink cartridge may comprise a float which floats on the ink within the ink cartridge, and a known printer may comprise an optical sensor positioned in the printer on the bottom side of the ink cartridge. In operation, by detecting the presence of the float on the bottom side of the ink cartridge using the optical sensor, it is possible to detect whether the ink within the ink cartridge has been reduced. Specifically, when there is a sufficient amount of ink within the ink cartridge, the float is positioned above the optical sensor, and the light of the optical sensor is not blocked by the float. Nevertheless, as the ink within the ink cartridge is consumed by the printer, the surface of the ink within the ink cartridge moves downwards, which causes the float to also move downwards. When the surface of the ink moves down to a predetermined level, the light from the optical sensor is blocked by the float, and the printer determines that there is an insufficient amount of ink within the ink cartridge.

Another known ink cartridge is an ink cartridge which may be installed in a printer from the horizontal direction. This known ink cartridge may comprise an ink supply outlet for supplying ink externally, which is positioned on the front surface of the ink cartridge in the insertion direction of the ink cartridge into the printer. A communication path in the ink cartridge for supplying ink to the printer is connected to the printer by the insertion operation of the ink cartridge from the horizontal direction. The communication path leading to the ink supply outlet extends in parallel to the insertion direction. For example, in this known ink cartridge, there is a flow outlet formed on the front surface of the ink cartridge in the insertion direction, which is connected to the flow inlet of the printer, and the flow outlet extends in the insertion direction of the ink cartridge. Because this ink cartridge is inserted into the printer in the horizontal direction, there is no need to provide access from the upper side of the printer when replacing the ink cartridge. Therefore, the space on the upper side of the printer may be effectively used, making it possible to overlay devices vertically.

SUMMARY OF THE INVENTION

A need has arisen for ink cartridges which overcome shortcomings of the related art. A technical advantage of the present invention is that the size of a printer may be reduced by configuring the printer and the ink cartridge, such that the presence of the float is detected on the front surface side of the ink cartridge in the insertion direction in which the communication path is formed. Another technical advantage of the present invention is that the ink cartridge may be installed in the printer from the horizontal direction, and still detect when there is an insufficient amount of ink within the ink cartridge.

An ink cartridge comprises an ink chamber comprising a wall having a first end and a second end opposite the first end, and a translucent portion positioned at the wall. The translucent portion is configured to be in fluid communication with the ink chamber, and the translucent portion has an inner space formed therein. The ink cartridge also comprises an ink supply portion having an opening formed therethrough. The ink supply portion is positioned at the wall adjacent to the second end of the wall, and the translucent portion is positioned between the first end of the wall and the ink supply portion. The ink cartridge also comprises a movable member comprising a signal blocking portion, and the signal blocking portion is disposed within the inner space of the translucent portion. The ink cartridge also comprises a float portion disposed within the ink chamber, and the float portion is configured to move between a first position and a second position based at least on an amount of ink disposed within the ink chamber. Specifically, as the ink within the ink chamber is dispensed from the interior of the ink chamber to the exterior of the ink chamber a surface of the ink within the ink chamber moves in a first predetermined direction, and when the float portion moves from the first position to the second position each of the float portion and the signal blocking portion moves in a second predetermined direction which is slanted with respect to the first predetermined direction.

BRIEF DESCRIPTION OF THE DRAWINGS

For a more complete understanding of the present invention, the needs satisfied thereby, and the features and technical advantages thereof, reference now is made to the following descriptions taken in connection with the accompanying drawings.

DETAILED DESCRIPTION OF EMBODIMENTS

Embodiments of the present invention and their features and technical advantages may be understood by referring to FIGS. 1-11, like numerals being used for like corresponding portions in the various drawings.

Figure 1:
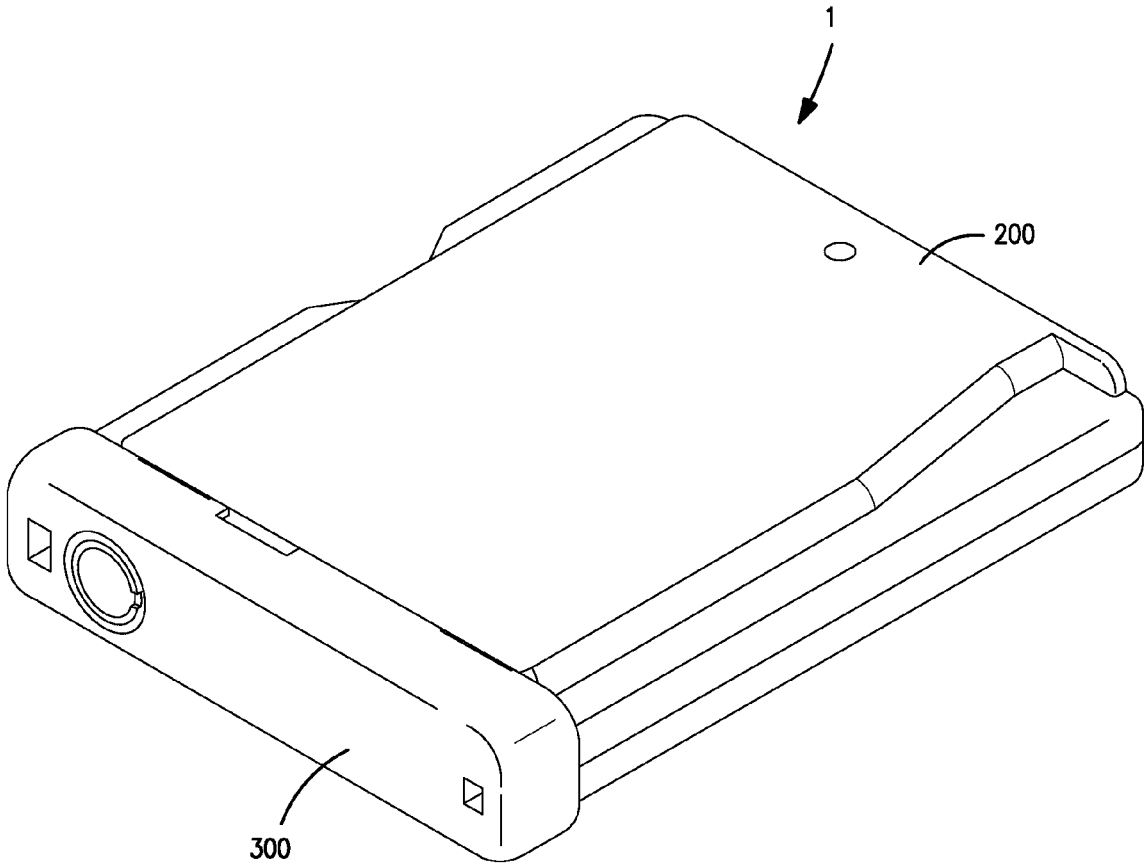
FIG. 1 is perspective view of an ink cartridge, according to an embodiment of the present invention.
Figure 2:
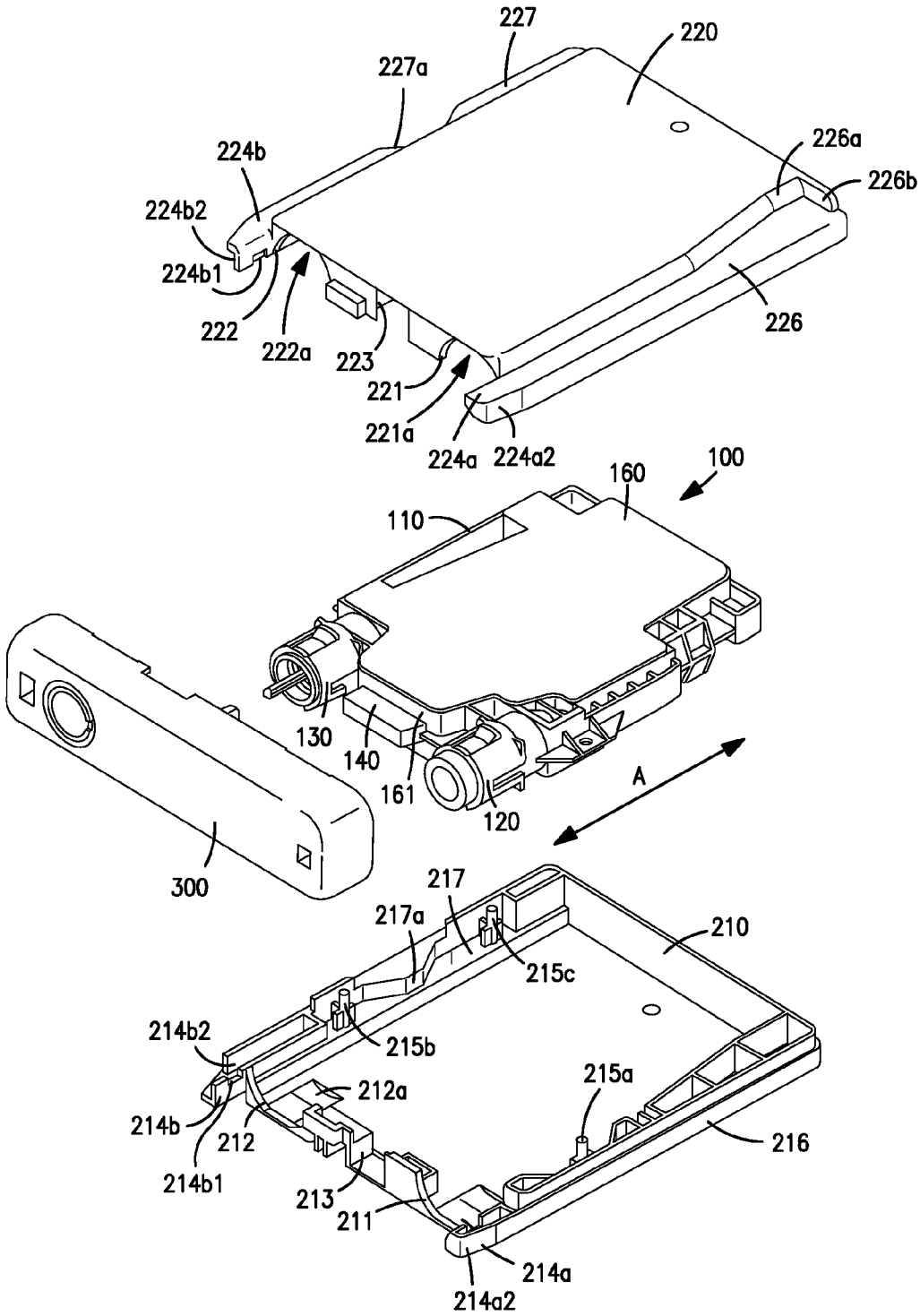
FIG. 2 is an expanded, perspective view of the ink cartridge of FIG. 1.

Referring to FIGS. 1 and 2, ink cartridge 1 may comprise an ink reservoir 100 which may store ink, e.g., a light-permeable ink, an external case 200 which may cover ink reservoir 100, and a protector 300 which may be connected to external case 200 to protect ink reservoir 100 when transporting ink cartridge 1. In an embodiment of the present invention, ink reservoir 100, external case 200 and protector 300 may comprise a resin material, such as nylon, polyethylene, polypropylene, or the like.

External case 200 may comprise a pair of case components 210 and 220 which sandwich ink reservoir 100 from above and below. First case member 210 may cover ink reservoir 100 in the lower side of FIG. 2, and second case member 220 may cover ink reservoir 100 in the upper side of FIG. 2. First and second case components 210 and 220 may comprise a resin material, and may be manufactured using injection molding.

A pair of case cut-out portions 211 and 212 may be formed in first case member 210 to expose ink supply portion 120 and air intake portion 130 to the outside of outer case 200. Case cut-out portions 211 and 212 may have a half-circle shape, cut-out portion 211 may be a cut-out corresponding to ink supply portion 120, and case cut-out portion 212 may be a cut-out corresponding to air intake portion 130. A case cut-out portion 213 may be formed between case cut-out portion 211 and case cut-out portion 212, and may have a rectangular shape. Cut-out portion 213 may be a cut-out for insertion of optical sensor 1014 to a position in which optical sensor 1014 sandwiches a translucent portion 140. Moreover, a contact groove 211*a* is formed on the inner side surface that is connected to case cut-out portion 211, and contact groove 211*a* contacts ink supply portion 120. Similarly, a contact groove 212*a* is formed on the inner side surface that is connected to case cut-out portion 212, and contact groove 212*a* contacts air intake portion 130. Contact grooves 211*a* and 212*a* may be used to align first case member 210 with ink reservoir 100.

Moreover, in first case member 210, a pair of case protrusion portions 214*a* and 214*b* may protrude toward protector 300 from the surface on which case cut-out portions 211-213 are formed. Case protrusion portions 214*a* and 214*b* may be formed on both ends of first case member 210, such that case cut-out portions 211-213 are positioned between them, and the one on the ink supply portion 120 side may comprise the case protrusion portion 214*a*, and the one on the air intake portion 130 side may comprise the case protrusion portion 214*b*. Case protrusion portion 214*a* may have a sloped surface 214*a*2 that is sloped toward case cut-out portions 211-213 from the portion that is connected to the side wall of first case member 210 to the edge of the case protrusion portion 214*a*. When ink cartridge 1 is installed in printer 1000, case protrusion portion 214*a* is on the lower side. Therefore, when installing ink cartridge 1, when sloped surface 214*a*2 contacts the lower portion of printer 1000, ink cartridge 1 may be induced to smoothly slide into a predetermined attachment position with the assistance of the slope.

Further, in case protrusion portion 214*b*, a case protrusion cut-out portion 214*b*1 may be formed on the inner side surface of case protrusion portion 214*b*, and case protrusion cut-out portion 214*b*1 may have a substantially rectangular shape. In addition, in case protrusion portion 214*b*, a case mating groove 214*b*2 may be formed, which is configured to mate with mating rod 1016*b*1 when ink cartridge 1 is installed in printer 1000.

Moreover, a rod member 215*a* may be formed on first case member 210 to align ink reservoir element 100, which protrudes in the second case member 220 direction near the side wall of the first case member 210 on the ink supply portion 120 side, and a pair of rod components 215*b* and 215*c* may be formed to align ink reservoir element 100, which protrude to the second case member 220 side near the side wall of the first case member 210 on the air intake portion 130 side. Because alignment of ink reservoir element 100 may be performed at the three locations associated with rod components 215*a*-215*c*, it may be possible to prevent ink reservoir element 100 from being attached in an incorrect orientation.

Within second case member 220, as in case member 210, not only may there be three case cut-out portions 221-223, there may be a contact groove 221*a* that is connected to case cut-out portion 221, and a contact groove 222*a* that is connected to the case cut-out portion 222. Moreover, on both sides of case cut-out portions 221-223, there may be case protrusion portions 224*a* and 224*b*, and case protrusion portion 224*a* may have a sloped surface 224*a*2 which is sloped in the case cut-out portion 221-223 direction towards the edge from the portion that is connected to the side surface of second case member 220. Further, in case protrusion portion 224*b*, there may be a case protrusion cut-out portion 224*b*1 with the same construction as case protrusion cut-out portion 214*b*1, and a case mating groove 224*b*2 formed that extends over the side surface of second case member 220 from the edge of case protrusion portion 224*b*. Within second case member 220, there may be a mating hole portion (not shown) having a hole for mating rod components 215*a*-215*c*.

First and second case members 210 and 220 may have a concave shape with both side surfaces in the direction that intersects the longitudinal direction A, and there may be a step formed in relation to the surface of first and second case members 210 and 220. In this stepped portion, first and second case members 210 and 220 may be attached, and ink reservoir element 110 may be fixed with respect to external case 200. The stepped portion of the ink supply portion 120 side may be the first case attachment portion 216 and 226, and the stepped portion of the air intake portion 130 side may be the second case attachment portion 217 and 227.

First case attachment portion 226 may be connected to the same planar surface as case protrusion portion 224*a*, a concave portion 226*a* may have a concave shape in the inner direction of second case member 220 on the opposite side to case protrusion portion 224*a*, and a mating portion 226*b* may mate with an engaging member 1017 when ink cartridge 1 is installed in printer 1000. Concave portion 226*a* is a region that allows movement of engaging member 1017 when the engaging member 1017 moves. Case attachment portion 227 may comprise a locking portion 227*a* which has a concave shape at a central position in the longitudinal direction of second case member 220, and locking portion 227*a* may be a portion which locks ink cartridge 1 when ink cartridge 1 is installed in printer 1000.

Although not discussed in detail, within first case member 210, there also may be a concave portion 216*a*, a mating portion 216*b*, and a locking portion 217*a* formed having substantially the same shape as concave portion 226*a*, mating portion 226*b*, and locking portion 227*a*, respectively, of second case member 220.

Referring to FIGS. 3-6, ink reservoir 100 may comprise an ink chamber 111, and an ink communication path 116. On the lower surface of case 110, a single attachment portion 110*a* may be provided, which extends downwards, and on the upper surface of case 110, a pair of attachment portions 110*b* and 110*c* may be provided, which extend upwards. Attachment portions 110*a*-110*c* may have through-holes 460*a*-460*c* which mate with rod components 215*a*-215*c*, respectively. Further, by mating through-holes 460*a*-460*c* with the rod components 215*a*-215*c*, respectively, it may be possible to align ink reservoir 100 into external case 200.

Ink chamber 111 may be provided in substantially the entire space within case 110 except for ink communication path 116, an air intake path 117, and a translucent portion 140. Ink may be stored within ink chamber 111. Such ink may have light-permeability properties, and may be supplied to printer 1000 from communication path 116. Specifically, communication path 116 may be in fluid communication with ink chamber 111 and ink supply portion 120, and may be configured to dispense ink from an interior of ink chamber 111 to an exterior of ink chamber 111 via an opening formed in ink supply portion 120. Communication path 116 may be substantially perpendicular to the wall on which ink supply portion 120, air intake portion 130, and translucent portion 140 are formed, and communication path 116 may have a center line C.

In an embodiment of the present invention, translucent portion 140 may protrude leftwards in the central portion in the vertical direction of side wall 161 on the left side of ink chamber 111. Inside translucent portion 140, an inner space 140*a* may be formed, which may communicate with ink chamber 111. Translucent portion 140 may be positioned between light emitting portion 1014*a* and light receiving portion 1014*b* of optical sensor 1014 when ink cartridge 1 is installed in printer 1000. Light emitting portion 1014*a* and light receiving portion 1014*b* may be positioned on the front side and the back side of FIG. 3. Translucent portion 140 may have light-permeable properties, e.g., may be translucent or transparent, and when the light emitted from light emitting portion 1014*a* is not blocked by light a blocking portion 32, the light is received by light receiving portion 1014*b*.

A float portion 30 may be provided within ink chamber 111. Float portion 30 may float on the ink within ink chamber 111, and may have a mass per unit volume which is less than mass per unit volume of the ink within ink chamber 111. Float portion 30 may have a rectangular-shaped float portion 31 inside of which air is present, and light blocking portion 32 which protrudes from the left side surface of float portion 31 in FIG. 3. Float portion 31 may have a length in the horizontal direction of FIGS. 4 and 5, which is greater than the length of inner space 140*a* of translucent portion 140. Consequently, float portion 31 may be prevented from entering translucent portion 140. Light blocking portion 32 may have a length in the horizontal direction of FIG. 4 and FIG. 5, which is less than the length of inner space 140*a* of translucent portion 140, making it possible for it to enter inner space 140*a*. Further, when light blocking portion 32 is positioned within inner space 140*a*, light blocking portion 32 blocks the light which is emitted from light emitting portion 1014*a* and which passes through translucent portion 140 on the surface of the front side of FIG. 3. Further, float portion 30 may comprise a pair of protrusions 33 formed on the two parallel side surfaces of float portion 31. Protrusions 33 may extend towards side walls 160 of case 110, respectively. Moreover, protrusions 33 may overlap each other in the perpendicular direction to the paper surface in FIG. 3, and as each protrusion 33 approaches communication path 116 in the vertical direction, they extend away from ink outlet 116*a* of communication path 116 in the horizontal direction, i.e., they extend obliquely downwards and to the right of FIG. 3. In an embodiment of the present invention, float portion 30 is unaligned with center line C of communication path 116 regardless of the position of float 30 within ink chamber 111.

Figure 3:
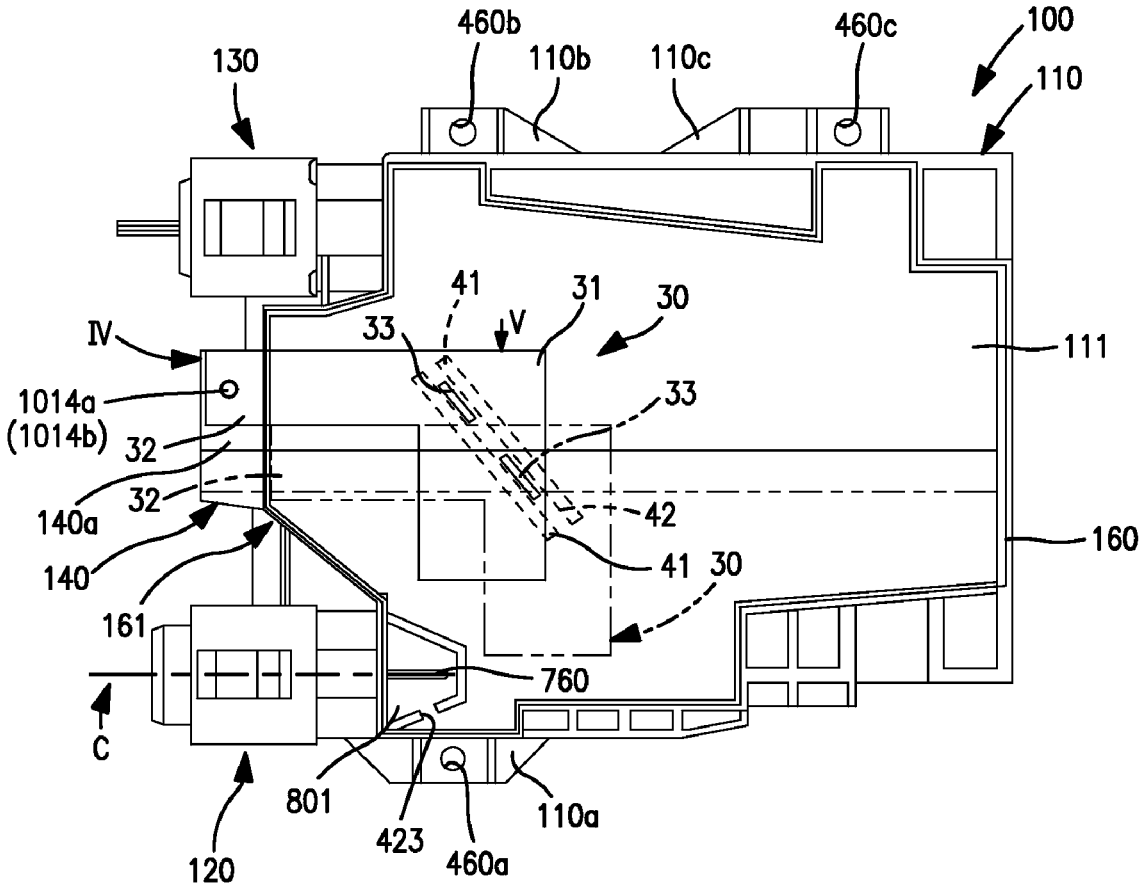
FIG. 3 is a side view of an ink reservoir unit of the ink cartridge of FIG. 2.
Figure 4:
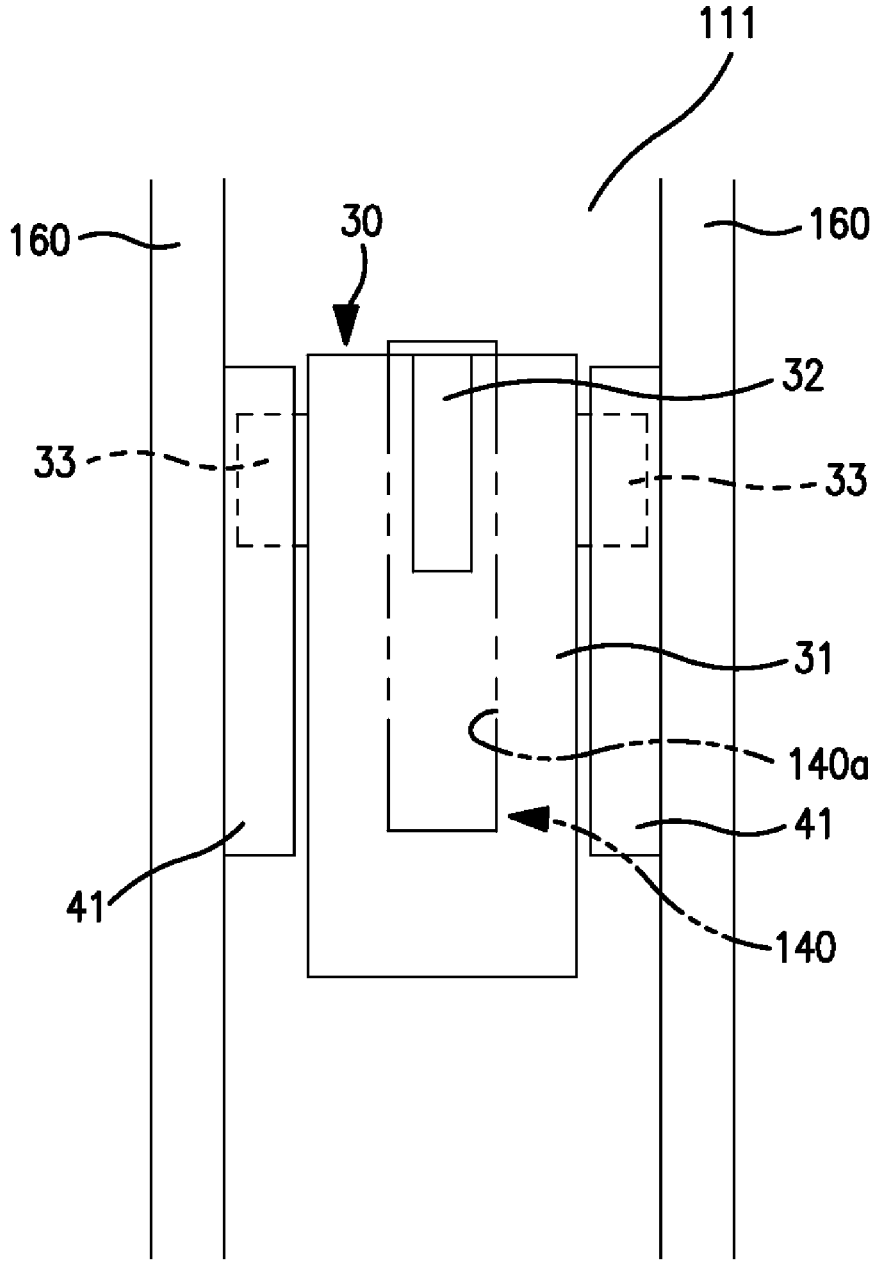
FIG. 4 is a diagram of the area in the vicinity of the float portion as seen from the IV direction of FIG. 3.
Figure 5:
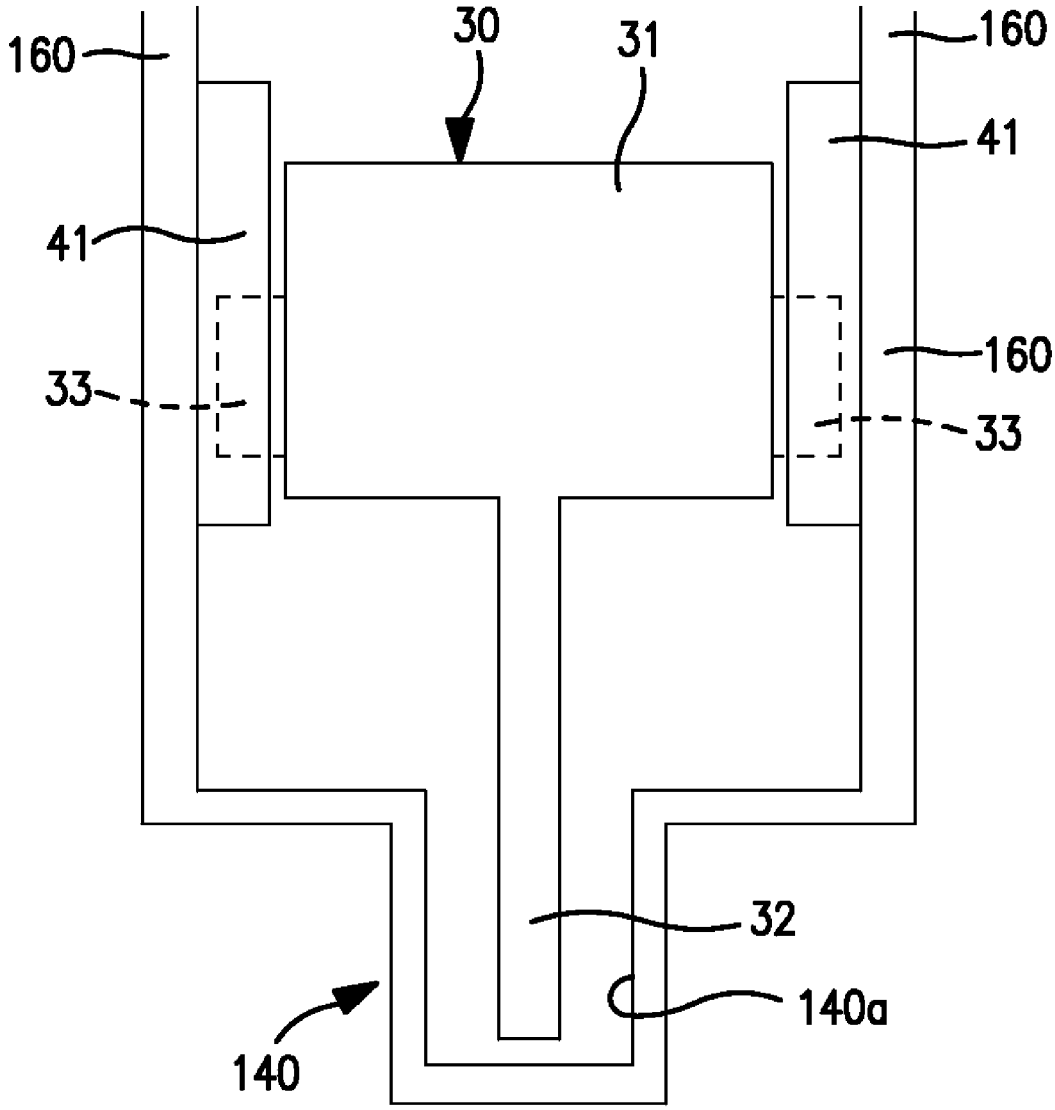
FIG. 5 is a diagram of the area in the vicinity of the float portion as seen from the V direction of FIG. 3.

On each of the inner side surfaces of the two side walls 160 that mutually face each other in case 110, a pair of guides 41 may extend in parallel to protrusions 33 downwards and to the right of FIG. 3 from a position above one edge portion of communication path 116, and a guide path 42 may be formed in the region sandwiched between guides 41. Similar to protrusions 33, guide path 42 may extend away from ink outlet 116*a* of communication path 116 in the horizontal direction as it approaches communication path 116 in the vertical direction. Protrusion 33 may be positioned between guides 41, such that protrusion 33 engages guides 41 and may slide in guide path 42. Further, as the ink within ink chamber 111 is gradually reduced, float portion 30 may track the height of the ink surface within ink chamber 111 as protrusion 33 slides along guide path 42. As a result, float portion 30 will move in a direction which is parallel to guide path 42. At this time, float portion 30 will be positioned away from ink outlet 116*a* of communication path 116 in the horizontal direction, e.g., in a direction along center line C of communication path 116 relative to when there is a large amount of ink remaining, preventing interference with communication path 116. Moreover, because protrusion 33 extends parallel to guide path 42, by bringing protrusion 33 into contact with guide 41, it is possible to prevent rotation when float portion 30 moves.

Figure 6:
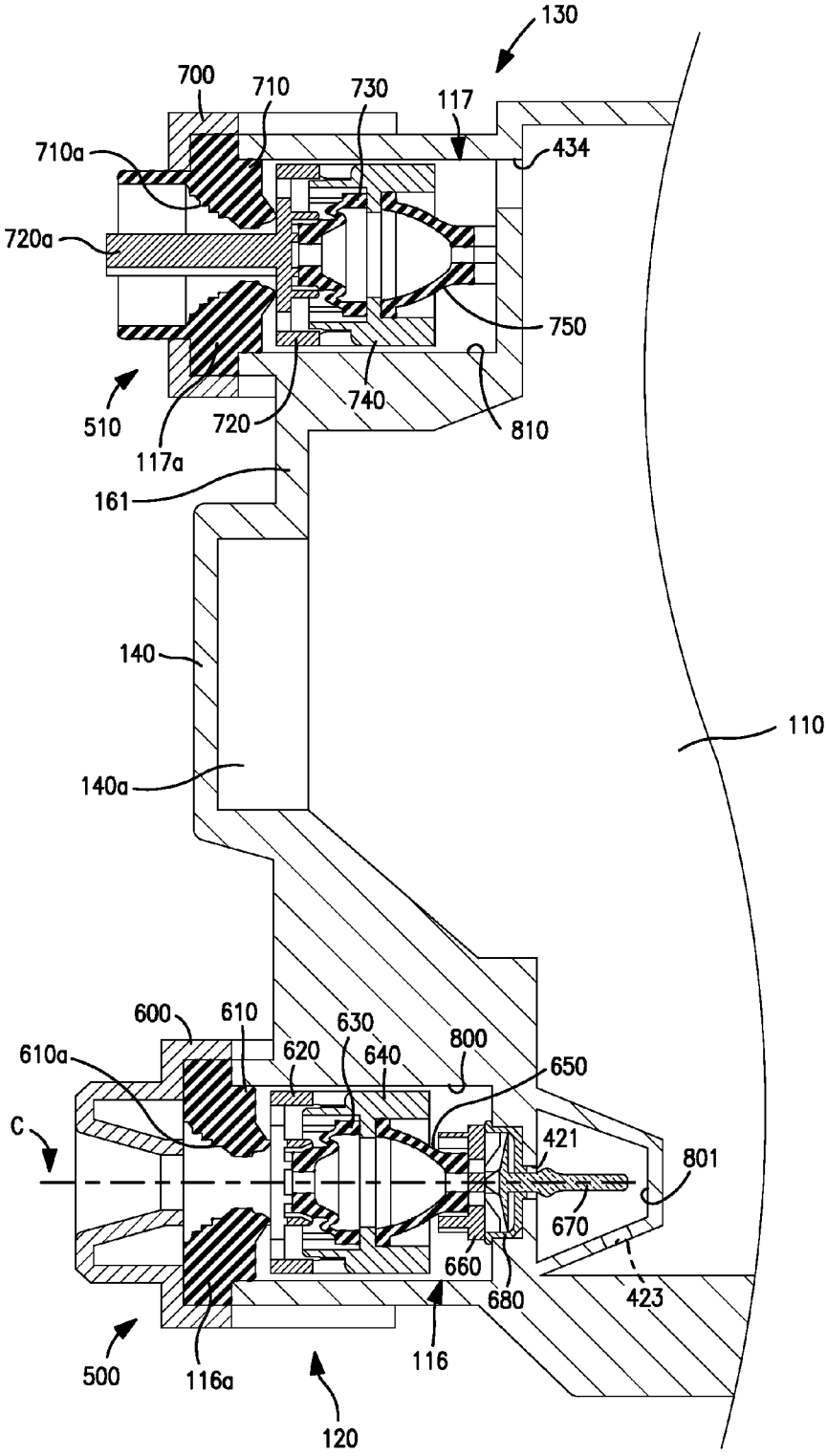
FIG. 6 is a partial, expanded view of the diagram of FIG. 3.

Referring to FIG. 6, communication path 116 may be positioned below translucent portion 140, and air intake path 117 may be positioned above translucent portion 140. When ink cartridge 1 is installed in printer 1000, communication path 116 and air intake path 117 extend in the horizontal direction. A valve mechanism 500 may be positioned within communication path 116, which may be configured to selectively open and close ink outlet 116*a* of communication path 116, an air intake mechanism 510 may be positioned within air intake path 117, which may be configured to selectively open and close air intake inlet 117*a* of air intake path 117. Further, ink supply portion 120 may be in fluid communication with communication path 116 and may comprise valve mechanism 500, and air intake portion 130 may be in communication with air intake path 117 and may comprise air intake mechanism 510.

Communication path 116 may comprise a valve storage portion 800 and an ink supply chamber 801. Valve storage portion 800 may store a portion of valve mechanism 500. Ink supply chamber 801 may communicate with valve storage portion 800 via connection hole 421 and may communicate with ink supply chamber 111 via connection hole 423. A path from ink supply chamber 801 to ink outlet 116*a* via connection hole 421 and valve storage portion 800 may extend in the horizontal direction. In communication path 116, the ink within ink chamber 111 may flow within ink supply chamber 801 via connection hole 423, and may flow to valve storage portion 800 via connection hole 421.

Valve mechanism 500 may comprise a supply cap 600, a supply joint 610, a supply valve 620, a first supply spring 630, a supply slider 640, a second supply spring 650, a valve seat 660, a check valve 670, and a cover 680. Supply cap 600 may be attached adjacent to ink outlet 116*a* of communication path 116. Supply joint 610 may comprise an elastic resin material, such as rubber. A through-hole 610*a* which extends in the horizontal direction may be formed in the central portion of supply joint 610, and an ink extraction pipe 1015 of printer 1000 may be inserted into through-hole 610*a*. Supply joint 610 covers the surrounding area of ink outlet 116*a* of communication path 116. When ink cartridge 1 is not installed in printer 1000, supply valve 620 may be pressed towards the left-hand side of FIG. 6 by a first supply spring 630, and the left side wall of supply valve 620 may contact the right side edge portion of supply joint 610, such that through-hole 610*a* may be closed. In contrast, when ink cartridge 1 is installed in printer 1000, supply joint 610 moves to the right side of FIG. 6 because it is pressed by ink extraction pipe 1015, and because a spacing is built up between supply joint 610 and supply valve 620, communication path 116 and ink extraction pipe 1015 communicate with each other, making it possible to supply ink to printer 1000. In this way, it is possible to perform opening and closing of ink outlet 116*a* of communication path 116.

First supply spring 630 and second supply spring 650 may sandwich supply slider 640. Supply slider 640 may operate in the movement direction, e.g., the right/left direction of FIG. 6, of supply valve 620, and it may cover the right side of supply valve 620. Second supply spring 650 may have substantially the same shape and may comprise substantially the same material as first supply spring 630, and may be stored within supply slider 640. Second supply spring 650 presses supply slider 640 to the left side. Valve seat 660 may contact second supply spring 650 and may support check valve 670. Check valve 670 may be positioned adjacent to connection hole 421 and may prevent back-flow of the ink in connection hole 421. Cover 680 and valve seat 660 may cover check valve 670.

Air intake path 117 extends in the horizontal direction, and may comprise an air intake mechanism storage portion 810 which stores a portion of air intake mechanism 510, and a connection hole 434 which provides communication between air intake mechanism storage portion 810 and ink chamber 111.

Air intake mechanism 510 may comprise an air cap 700, an air joint 710, an air valve 720, a first air spring 730, an air slider 740, and a second air spring 750. Air cap 700 may be connected to an air intake inlet 117*a* of air intake path 117. Air joint 710 may comprise an elastic resin material, such as rubber. A through-hole 710*a* which extends in the horizontal direction may be formed in the central portion of air joint 710. Air joint 710 covers the surrounding area of air intake inlet 117*a*. When ink cartridge 1 is not installed in printer 1000, supply valve 720 may be pressed to the left-hand direction of FIG. 4 by first supply spring 730. The left side wall of supply valve 720 may contact the right edge portion of supply joint 710, such that through-hole 710*a* may be closed. In contrast, when ink cartridge 1 is installed in printer 1000, protrusion portion 720*a* which protrudes to the outer side of ink intake inlet 117*a* from the left edge of air valve 720 moves to the right side of FIG. 4 because it is pressed by contact with the attachment surface 1013, and because a spacing is created between air joint 710 and air valve 720, air intake path 117 and air intake portion 1013*b* communicate with each other, enabling the intake of air. In this way, it is possible to perform opening and closing of air intake inlet 117*a* of air intake path 117.

First air spring 730 and second air spring 750 may sandwich air slider 740. Air slider 740 covers the right side of air valve 720. Air slider 740 also may operate in the movement direction, e.g., the right/left direction of FIG. 4, of air valve 720 which is pressed by contact with the wall surface of attachment surface 1013. Second air spring 750 may have substantially the same shape and may comprise substantially the same material as first air spring 730. Second air spring 750 may be stored within air slider 740, and it may press air slider 740 to the left side.

Figure 7A:
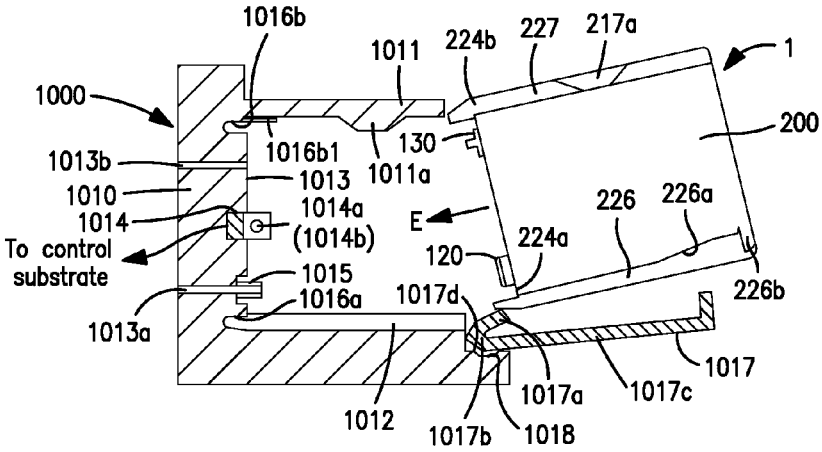
FIGS. 7(*a*)-7(*c*) are diagrams showing a method of installing the ink cartridge of FIG. 1 into a printer, according to an embodiment of the present invention.
Figure 7B:
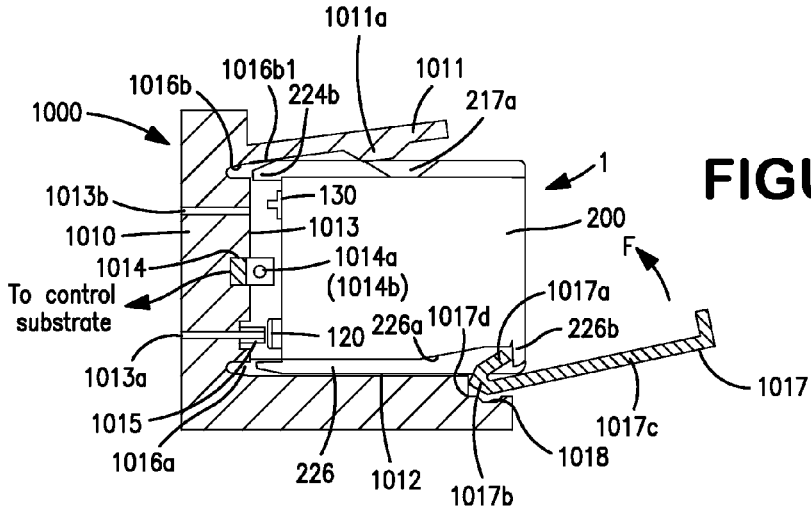
Figure 7C:
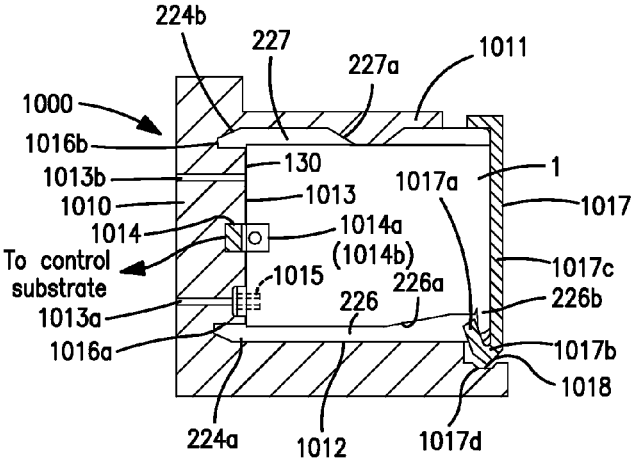

Referring to FIG. 7(*a*), an installation portion 1010 of printer 1000 may comprise a locking rod 1011 that protrudes in the right-side direction in FIG. 7(*a*) from installation portion 1010. Locking rod 1011 locks locking portions 217*a* and 227*b* of external case 200. Installation portion 1010 also may comprise a support portion 1012 which supports first case attachment portions 216 and 226 of external case 200 from below and has a concave shape corresponding to the shape of first attachment portions 216 and 226. Moreover, a convex portion 1011*a* may be formed on locking rod 1011, which protrudes toward support portion 1012 and has the same shape as locking portions 217*a* and 227*a*.

Optical sensor 1014, e.g., a U-shaped optical sensor, may be provided on installation surface 1013 of installation portion 1010. One end of optical sensor 1014 may be light emitting portion 1014*a* which emits light, and the other end of optical sensor 1014 may be light receiving portion 1014*b* which receives the light. Light emitting portion 1014*a* and light receiving portion 1014*b* protrude from installation surface 1013, such that they may be inserted into the through-holes formed by case cut-out portions 213 and 223 and translucent portion 140. When the light emitted from light emitting portion 1014*a* is received by light receiving portion 1014*b*, optical sensor 1014 outputs a signal to the control substrate (not shown) in printer 1000, and when the light emitted from light emitting portion 1014*a* is blocked and light receiving portion 1014*b* does not receive the light, no signal is output to the control substrate, and it is possible to print.

Moreover, ink extraction pipe 1015 protrudes from installation surface 1013 on the side corresponding to ink supply portion 120, and installation surface 1013 on the side corresponding to air intake portion 130 may have a planar surface. Ink extraction pipe 1015 may be positioned below optical sensor 1014. Ink path 1013*a* may be connected to ink extraction pipe 1015, and ink may be supplied to printer 1000 via ink path 1013*a*. An air intake path 1013*b* may be formed on installation surface 1013 on the air intake portion 130 side, and air may be drawn into ink chamber 111 via air intake path 1013*b*.

Case protrusion portions 214*a* and 224*a* and case protrusion portions 214*b* and 224*b* of the external case 200 may be inserted into both sides of installation surface 1013, and concave portions 1016*a* and 1016*b* may be formed corresponding to the outer shape of case protrusion portions 214*a* and 224*a* and case protrusion portions 214*b* and 224*b*. Further, a mating rod 1016*b*1 may be formed on concave portion 1016*b*, which may mate with the mating groove which is formed by case mating grooves 214*b*2 and 224*b*2 of external case 200. When ink cartridge 1 is installed, mating rod 1016*b*1 may be inserted into the mating groove formed by case mating grooves 214*b*2 and 224*b*2. Specifically, not only may the shape of the case protrusion portion formed by case protrusion portions 214*a* and 224*a* be different from that of the case protrusion portion formed by case protrusion portions 214*b* and 224*b*, because the shapes of concave portions 1016*a* and 1016*b* of printer 1000 also may be different, when ink cartridge 1 is installed upside-down, mating rod 1016*b*1 becomes an obstacle and ink cartridge 1 cannot be incorrectly installed. Because improper installation of ink cartridge 1 is prevented, it is possible to prevent damage to ink supply portion 120, air intake portion 130, optical sensor 1014, and ink extraction pipe 1015.

Further, within installation portion 1010 and on the edge side of support portion 1012, an engaging member 1017 configured to rotate and to engage mating portions 216*b* and 226*b* may be provided. Engaging member 1017 may fit inside concave portions 216*a* and 226*a* of external case 200. Engaging member 1017 may comprise each of an engaging edge 1017*a* which engages with mating portions 216*b* and 226*b* of external case 200, an axis portion 1017*b* which is connected to engaging edge 1017*a* and which acts as the axis of the rotation of engaging member 1017, and a covering portion 1017*c* which is connected to axis portion 1017*b* and covers the side surface of the external case opposite from the side surface facing installation surface 1013. A convex portion 1017*d* may be formed and may protrude in the circumferential direction from axis portion 1017*b*. Engaging member 1017 may be positioned in an upright posture through the engagement of convex portion 1017*d* with concave portion 1018 which is formed on attachment portion 1010 of printer 1000.

As shown in FIG. 7(*a*), when ink cartridge 1 is installed in printer 1000, ink cartridge 1 may be installed, such that ink supply portion 120 is on the lower side and air intake portion 130 is on the upper side. Specifically, if ink supply portion 120 is not positioned on the lower side, the ink within ink cartridge 1 may not be efficiently used.

Also, when ink cartridge 1 is installed in printer 1000, ink supply portion 120, translucent portion 140, and air intake portion 130 may be positioned in this order from the bottom to the top and, ink supply portion 120, translucent portion 140, and air intake portion 130 may be formed on the same surface. Therefore, because ink supply portion 120, translucent portion 140, and air intake portion 130 may be positioned relatively close to each other on the same surface, it is possible to position optical sensor 1014, ink extraction pipe 1015, and air intake path 1013*b* relatively close to each other on the same surface of printer 1000, such that it is possible to reduce the size of printer 1000.

Installation of ink cartridge 1 may be performed by inserting case protrusion portions 214*a* and 224*a* of the external case 200, such that they contact support portion 1012, and pushing ink cartridge 1, such that first case attachment portions 216 and 226 slides across the top of support portion 1012, e.g., in the direction of the arrow E. As described above, because sloped surfaces 214*a*2 and 224*a*2 may be formed on case protrusions 214*a* and 224*a*, it is possible to smoothly insert ink cartridge 1 onto support portion 1012 using sloped surfaces 214*a*2 and 224*a*2.

As shown in FIG. 7(*b*), when ink cartridge 1 is pressed toward installation portion 1010, locking rod 1011 is pressed by second case attachment portions 217 and 227 and elastically deforms in the direction away from support portion 1012. Moreover, engaging edge portion 1017*a* of engaging member 1017 comes within concave portions 216*a* and 226*a* of external case 200, and then, these come into contact with the mating portions 216*b* and 226*b*. Further, when ink cartridge 1 is inserted, engaging member 1017 rotates upwards.

As shown in FIG. 7(*c*), when ink cartridge 1 is inserted even further from the state shown in FIG. 7(*b*), e.g., when engaging member 1017 is rotated in the arrow F direction by the user, convex portion 1011*a* of locking rod 1011 fits into and engages with locking portions 217*a* and 227*a* of external case 200, which fixes ink cartridge 1. Moreover, convex portion 1017*d* of engaging member 1017 engages with concave portion 1018, thereby fixing ink cartridge 1. Therefore, when ink cartridge 1 is installed in installation portion 1010, it is possible to prevent easy dislodging of ink cartridge 1 due to vibrations caused by printing or the like. In addition, because movement of ink cartridge 1 in the vertical direction may be restricted by locking rod 1011 and support portion 1012, it is possible to prevent damage to optical sensor 1014 and ink extraction pipe 1015 due to insertion of ink cartridge 1 at an angle.

When ink cartridge 1 is installed in installation portion 1010, ink extraction pipe 1015 may be inserted inside ink supply portion 120, and ink may be supplied. Moreover, as protrusion portion 720*a* of air valve 720 of air intake portion 130 contacts attachment surface 1013, air may be drawn inside, and when optical sensor 1014 is inserted into the through-hole formed by case cut-out portions 213 and 223 and translucent portion 140, the amount of ink may be detected.

Moreover, when ink cartridge 1 is installed in installation portion 1010, optical sensor 1014 is inserted into the through-holes formed by case cut-out portions 213 and 223 and translucent portion 140, such that light emitting portion 1014*a* and light receiving portion 1014*b* of optical sensor 1014 are positioned within external case 200. Therefore, it may be possible to prevent inaccurate detection of ink due to dust or debris on light emitting portion 1014*a* or light receiving portion 1014*b*.

Referring again to FIG. 3, when there is a sufficient amount of ink within ink chamber 111, float portion 30 will float on the surface of the ink within ink chamber 111 due to buoyancy. However, as the top edge of light blocking portion 32 contacts the upper surface of translucent portion 140 bounding the top portion of inner space 140*a*, float portion 30 does not move any higher than the position shown by the solid line in FIG. 3, and protrusion 33 is positioned near the upper edge of guide path 42. At this time, the edge portion of light blocking portion 32 is positioned in inner space 140*a* of translucent portion 140, and as the light emitted by light emitting portion 1014*a* is blocked by light blocking portion 32, light receiving portion 1014*a* does not receive any light. Therefore, optical sensor 1014 does not output a signal to the control substrate, and printing is permitted.

As the ink within ink chamber 111 is consumed, the surface of the ink within ink chamber 111 moves downward, thereby causing float portion 30 to move downwards and to the right in FIG. 3, and light blocking portion 32 will no longer block the light emitted from light emitting portion 1014*a*, and the light receiving portion 1014*b* receives the light. A signal then is output from optical sensor 1014 to the control substrate, and a warning to change the ink cartridge is generated.

When there is a relatively large amount of ink remaining, float portion 30 is positioned above communication path 116, however, because guide path 42 is sloped such that it backs away from ink outlet 116*a* of communication path 116 in the horizontal direction as it approaches communication path 116 in the vertical direction, as the amount of remaining ink decreases, even if float portion 30 moves downwards, there is no interference with communication path 116, such that the movement of float portion 30 is not obstructed. Therefore, when float portion 30 has moved downward to about the same height as communication path 116, light blocking portion 32 will not block the light emitted from light emitting portion 1014*a*, and it is possible to detect that the amount of ink has been reduced when the amount of ink remaining actually has decreased.

Moreover, because valve mechanism 500 is stored within communication path 116, when ink cartridge 1 is installed in printer 1000, the ink will be supplied, and when ink cartridge 1 is removed from printer 1000, ink may not leak.

Figure 8:
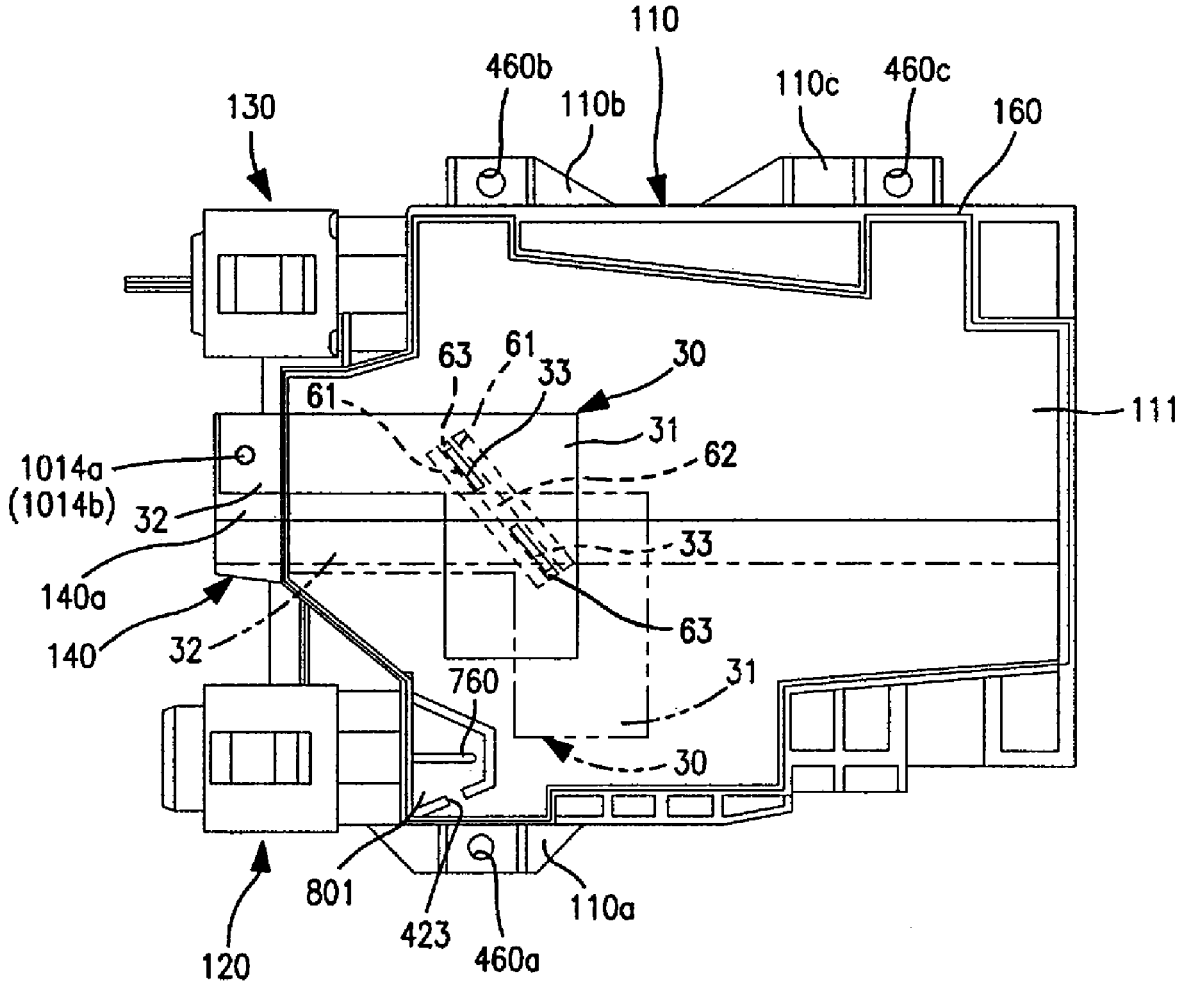
FIG. 8 is a side view of a of an ink reservoir unit, according to another embodiment of the present invention.

FIG. 8 depicts a modification of the above-described embodiments of the present invention. In this embodiment of the present invention, a plurality of stoppers 63, e.g., a pair of stoppers, may be formed adjacent to each edge of lower side guide 61 and may extend towards guide path 62. In this case, when there is a sufficient amount of ink within ink chamber 111, and when float portion 30 tries to float due to buoyancy, as shown by the solid line in FIG. 8, the upper edge of light blocking portion 32 will not only contact the upper surface of translucent portion 140 bounding the top portion of inner space 140*a*, but also the top edge of protrusion 33 contacts stopper 63, which prevents float portion 30 from moving any further upwards. On the other hand, when float portion 30 moves downwards as the ink within ink chamber 111 is reduced, as shown by the double-dotted line in FIG. 8, the lower edge of protrusion 33 contacts stopper 63, which prevents float portion 30 from moving any further downwards. Thus, stopper 63 may prevent protrusion 33 from dislodging from guide path 62, and it is possible to shorten the length of guide 61. Alternatively, stoppers 63 may be formed on upper guide 61, or one stopper 63 may be formed on each of the upper and lower guides 61. In this example, stoppers 63 formed on the upper and lower guides 61 may be formed separately or as a single unit.

Figure 9:
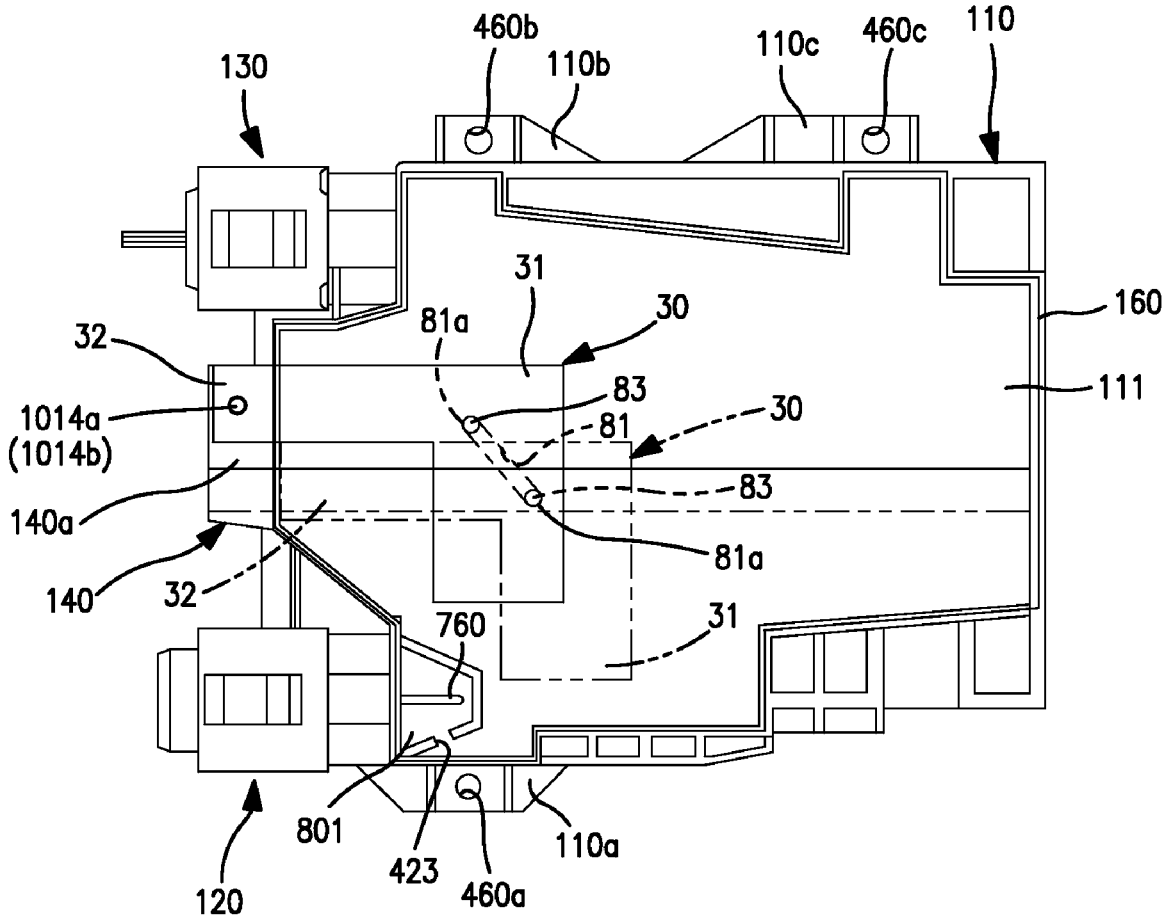
FIG. 9 is a side view of an ink reservoir unit, according to yet another embodiment of the present invention.
Figure 10:
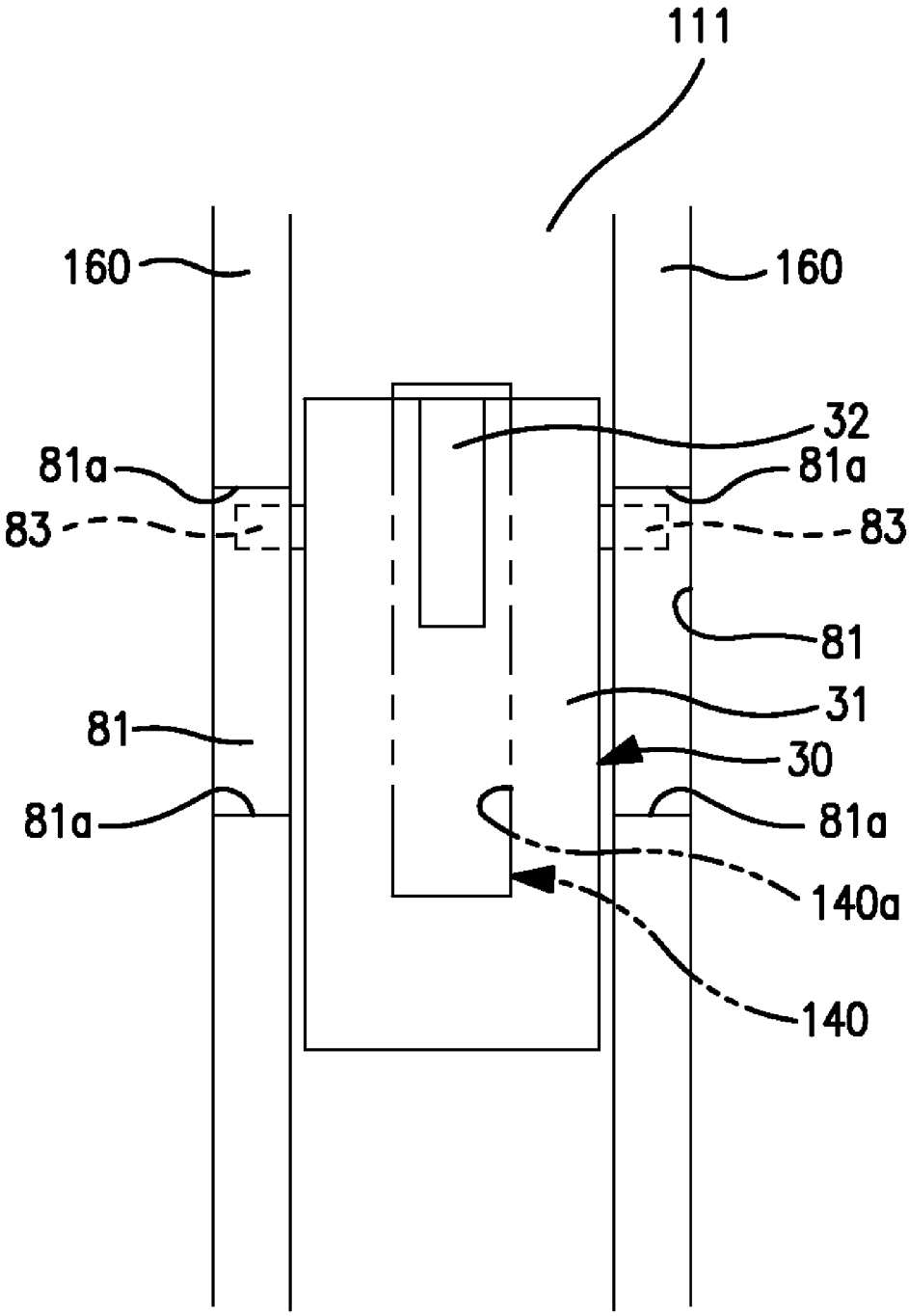
FIG. 10 is a diagram of the area in the vicinity of a float portion, according to another embodiment of the present invention.
Figure 11:
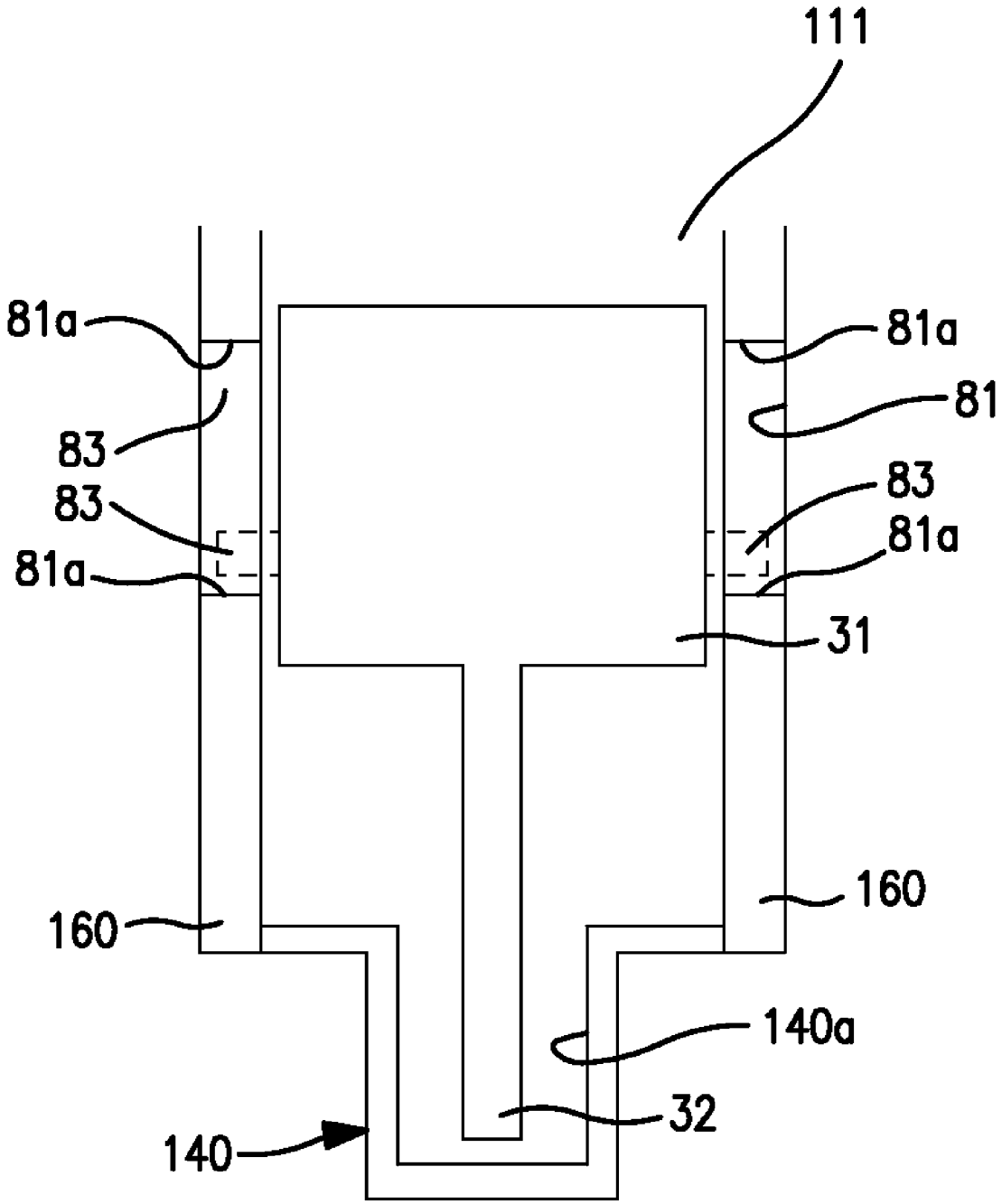
FIG. 11 is a diagram of the area in the vicinity of a float portion, according to yet another embodiment of the present invention.

FIGS. 9-11 depict another modification of the above-described embodiments of the present invention. In this embodiment, round, pillar-shaped protrusions 83 may be formed on each of the two parallel side surfaces. Protrusions 83 extend towards the side walls 160 of case 110, respectively, in the perpendicular direction to the paper in FIG. 9, and on each of the two side walls 160 of case 110, a guide groove 81 may be formed, which extends downwards and to the right of FIG. 9. Guide grooves 81 may overlap each other in the perpendicular direction of the paper in FIG. 9. Then, protrusions 83 may be fitted within the corresponding guide grooves 81, such that they may slide. Moreover, by sliding protrusion 83 along guide groove 81, float portion 30 may move in a direction parallel to guide groove 81. In this example of the present invention, side surfaces 81*a* of upper edge portion and lower edge portion of guide groove 81 performs the role of the stopper, and by contacting protrusion 83 with side surfaces 81*a*, it is possible to prevent dislodging of the protrusion 83 from the guide groove 81. Alternately, protrusion 83 may extend in parallel with guide groove 81.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

What is claimed is:

1. An ink cartridge, comprising:

an ink chamber comprising a wall having a first end and a second end opposite the first end;

a translucent portion positioned at the wall, wherein the translucent portion is configured to be in fluid communication with the ink chamber, and the translucent portion has an inner space formed therein;

an ink supply portion having an opening formed therethrough, wherein the ink supply portion is positioned at the wall adjacent to the second end of the wall, and the translucent portion is positioned between the first end of the wall and the ink supply portion;

a movable member comprising:

a signal blocking portion, wherein the signal blocking portion is disposed within the inner space of the translucent portion; and a float portion disposed within the ink chamber, wherein the float portion is configured to move between a first position and a second position based at least on an amount of ink disposed within the ink chamber, wherein as the ink within the ink chamber is dispensed from the interior of the ink chamber to the exterior of the ink chamber a surface of the ink within the ink chamber moves in a first predetermined direction, and when the float portion moves from the first position to the second position each of the float portion and the signal blocking portion moves in a second predetermined direction which is slanted with respect to the first predetermined direction; and at least one guide, wherein the float portion slides along the at least one guide when the float portion moves from the first position to the second position.

2. The ink cartridge of claim 1, further comprising a communication path configured to dispense ink from an interior of the ink chamber to an exterior of the ink chamber via the opening formed through the ink supply portion, wherein the float portion is unaligned with a center line of the communication path when the float portion is in the first position or the second position.

3. The ink cartridge of claim 2, wherein the float portion comprises at least one protrusion which slidably engages the at least one guide.

4. The ink cartridge of claim 3, wherein the at least one protrusion extends parallel to the at least one guide.

5. The ink cartridge of claim 2, wherein the float portion comprises a plurality of protrusions which slidably engage the at least one guide.

6. The ink cartridge of claim 5, wherein each of the plurality of protrusions extend parallel to the at least one guide.

7. The ink cartridge of claim 6, wherein when the float portion moves from the first position to the second position each of the float portion and the signal blocking portion moves in a same direction.

8. The ink cartridge of claim 1, further comprising a communication path configured to dispense ink from an interior of the ink chamber to an exterior of the ink chamber via the opening formed through the ink supply portion, wherein the float portion moves from the first position to the second position based at least on decrease of the amount of ink disposed within the ink chamber, and a first distance between the float portion and the communication path in a third direction along a center line of the communication path when the float portion is in the second position is greater than a second distance between the float portion and the communication path in the third direction when the float is in the first position.

* * * * *